United States Patent [19]

Woodard, Jr. et al.

[11] Patent Number: 4,923,583

[45] Date of Patent: May 8, 1990

[54] ELECTRODE ELEMENTS FOR FILTER PRESS MEMBRANE ELECTROLYTIC CELLS

[75] Inventors: Kenneth E. Woodard, Jr., Cleveland, Tenn.; Julius C. Fister, Jr., Hamden, Conn.; David L. Fair, Cheshire, Conn.; Robert A. Dean, Guilford, Conn.

[73] Assignee: Olin Corporation, Cheshire, Conn.

[21] Appl. No.: 795,013

[22] Filed: Nov. 4, 1985

[51] Int. Cl.[5] ..... C25B 11/02

[52] U.S. Cl. ..... 204/286; 204/279; 204/280; 204/290 R; 204/291; 204/292; 204/293; 204/290 F; 228/193; 228/194; 228/195

[58] Field of Search ..... 204/252–254, 204/267, 268, 279, 286, 290 R, 290 F, 280, 291, 292; 228/193–195

[56] References Cited

U.S. PATENT DOCUMENTS

| | | | |
|---|---|---|---|
| 3,380,908 | 4/1968 | Ono et al. | 204/292 |
| 3,444,608 | 5/1969 | Conn, Jr. et al. | 29/423 |
| 3,493,415 | 2/1970 | Grisaffe et al. | 117/50 |
| 3,555,667 | 1/1971 | Carlson et al. | 228/193 |
| 3,789,498 | 2/1974 | Cole | 29/470.9 |
| 3,859,197 | 1/1975 | Bouy et al. | 204/254 |
| 4,081,901 | 4/1978 | Miller | 228/193 |
| 4,220,276 | 9/1980 | Weisert et al. | 228/118 |
| 4,233,831 | 11/1980 | Hamilton et al. | 72/60 |
| 4,269,053 | 5/1981 | Agrawal et al. | 72/42 |
| 4,279,731 | 7/1981 | Pellegri | 204/290 R |
| 4,303,570 | 12/1981 | Weisert et al. | 260/31.2 R |
| 4,304,350 | 12/1981 | Paez et al. | 228/118 |
| 4,306,436 | 12/1981 | Schulz et al. | 72/21 |
| 4,331,284 | 5/1982 | Schulz et al. | 228/157 |
| 4,402,809 | 9/1983 | Dilmore et al. | 204/254 |
| 4,514,470 | 4/1985 | Rosenthal | 428/662 |
| 4,534,846 | 8/1985 | Woodard, Jr. et al. | 204/290 R |
| 4,549,685 | 10/1985 | Paez | 228/193 |

OTHER PUBLICATIONS

Alm, "Diffusion Bonding Part 1", Mechanical Engineering, May 1970, pp. 24–32.

European Patent Publication No. WO84/02537 published Jul. 5, 1984 to Abrahamson et al.

Article entitled, "Conductive Adhesives, Inks and Coatings", by Dr. Justin C. Bolger, Robert J. Astile and Silvio L. Morano.

*Primary Examiner*—John F. Niebling
*Assistant Examiner*—Kathryn Gorgos
*Attorney, Agent, or Firm*—Ralph D'Alessandro

[57] ABSTRACT

An electrode is provided which is formed by the metallurgical bonding technique of diffusion bonding the backplate, conductor elements and electrode surface together, then applying the catalytic coating to the electrode surface, and bonding the backplate to an electrical conducting plate.

33 Claims, 2 Drawing Sheets

ELECTRODE ELEMENTS FOR FILTER PRESS MEMBRANE ELECTROLYTIC CELLS

BACKGROUND OF THE INVENTION

The present invention relates generally to electrodes used in electrolytic cells. More specifically, the present invention relates to the improved electrode that may be employed in electrolytic cells produced by the metallurgical bonding technique of diffusion bonding.

Chlorine and caustic, products of the electrolytic process, are basic chemicals which have become large volume commodities in the industrialized world today. The overwhelming amounts of these chemicals are produced electrolytically from aqueous solutions of alkali metal chlorides. Cells which have traditionally produced these chemicals have come to be known as chloralkali cells. The chloralkali cells today are generally of two principal types, the deposited asbestos diaphragm-type electrolytic cell or the flowing mercury cathode-type.

Comparatively recent technological advances such as the development of dimensionally stable anodes and various coating compositions, have permitted the gap between electrodes to be substantially decreased or eliminated entirely. This has dramatically increased the energy efficiency during the operation of these energy-intensive units.

The development of a hydraulically impermeable, ion selective membrane has promoted the advent of filter press membrane chloralkali cells which produce a relatively uncontaminated caustic product. This higher purity product obviates the need for caustic purification and decreases the need for concentration processing. The use of a hydraulically impermeable planar membrane has been most common in bipolar filter press membrane electrolytic cells. However, continual advances have been made in the development of monopolar filter press membrane cells. A hydraulically impermeable membrane also has found utility in electrolytic cells other than chloralkali electrolytic cells.

The use of a hydraulically impermeable membrane, however, presents problems should the membrane become structurally damaged, such as ruptured by the passage of a sharp object therethrough. The puncturing of membranes by abrasion or puncturing with sharp electrode components is particularly troublesome since it permits the cross migration of ions between the anode and cathode compartments. This reduces the efficiency of the cell. Frequently the cause of these abrading electrode components are roughened weld surfaces or the unrestrained electrode component that results when a weld on the electrode fails.

The number of welds on an electrode are numberous since each separately formed electrode element must be joined together. These elements include the individual electrode frame members, the electric current conducting elements and the electrode surfaces. The electrode surfaces, typically formed of a mesh, perforated or punched metal, especially have a large number of individually welded connections. Since the ion selective membranes are placed against these electrode surfaces, roughened weld surfaces or broken welds will easily puncture a membrane.

Welding presents the additional problem of building up heat in the electrode components as they are joined together in assembly, frequently causing warpage or distortion that affects the ability of the electrode to function efficiently. Warpage creates a non-planar surface that results in poor or non-uniform current distribution during operation across the electrode surface. This warpage also causes the welds to either fail completely or to be subjected to extreme stress at the weld points when subjected to the assembly pressures necessary to compress and assemble the cell in a configuration that requires planar electrodes.

These membranes are expensive. A commercial-size membrane cell, for example of the filter press type, will have up to thirteen or more membranes in each electrolytic cell unit comprising multiple cathode and anode units separated by a membrane. Damaged membranes therefore either require expensive replacements or are time consuming to locate and repair. Consequently, repair or replacement is a costly manual process. The exact position of structurally damaged membranes in the electrolytic cell unit must be identified before they can be replaced.

Damaged membranes can also cause corrosion to occur in the metals used internally within the electrolytic cell by permitting the catholyte fluid with caustic or the anolyte fluid with brine to cross through the ruptured membrane and enter the adjacent electrode compartment. Caustic is extremely corrosive to the anode metals and the brine with chlorine in the anolyte will dissolve nickel in a cathode, forming a high oxidation state nickel compound that will build up in the membrane. Where titanium is used in the anode, caustic will dissolve it, forming a titanium oxide that will also buildup in the membrane. This metallic ion buildup in the membrane decreases the current efficiency of the cell and increases the cell voltage.

Damaged membranes additionally will decrease the overall efficiency of the operating cell by decreasing the cathode and anode current efficiencies. The cathode current efficiency decreases are detectable in several ways, such as by measuring the weight of the caustic produced in a container vessel, calculating the actual production rate, and then comparing it to the expected production rate. Decreases in anode current efficiency are detectable because of the increase in the presence of oxygen in the cell gas and oxychlorides, such as hypochlorite, or chlorates in the spent anolyte stream or spent brine in a chloralkali cell. Changes in the pH of the spent anolyte stream are also indicative of such decreases. Obviously, damage to or ruptures of the membranes reduce the production capacity of the electrolytic unit, affect the quality of the cell product and adversely affect the economics of an operating commercial unit.

Another related disadvantage of electrodes which must be welded together at the joints between various components is the amount of labor involved. Welding, whether TIG welding, resistance welding or spot welding, is labor-intensive and requires sizeable periods of time. It is difficult to adhere to the required tolerances where hand operations, such as welding, are performed. These tolerances are most critical in electrolytic cells that have no gap between the membranes and the adjacent cells. Additionally, the welds may not be consistently or uniformly made. The labor-intensive manual welding involved in the fabricating of an electrode significantly increases the cost of each cell. While it has been known for a number of years that certain metals, such as titanium and various alloys, may be metallurgically joined together by applying heat and pressure for a sufficient amount of time to cause intimate surface contact and interdiffusion of the atoms at the joint interface, such technology has not previously been successfully applied to electrolytic cell components. Similarly, while it has been known that certain metals, including titanium and various alloys, exhibit the characteristic of superplasticity or the ability of a material to develop unusually high tensile elongations under conditions of increased pressure and temperature, this process has not been previously successfully applied to the production of electrolytic cells. More recently, the combining of superplastic forming and diffusion bonding technology in making structural components has been accomplished, most notably in the aviation industry.

The foregoing problems are solved by the product made by the process or method of the present invention wherein an electrode is formed by the metallurgical bonding technique of diffusion bonding and the adhesion of the corrosion-resistant electrode material to a conducting plate carrying electrical current to the electrode in a manner that reduces the electrical current flow resistance and the cost of the final electrode.

SUMMARY OF THE INVENTION

It is an object of the present invention to provide an electrode usable in an electrolytic cell that is fabricated employing the metallurgical bonding technique of diffusion bonding It is another object of the present invention to provide an electrode usable in an electrolytic cell that is fabricated by assembling a diffusion bonded subunit including at least a backplate, conducting elements and an electrode surface to a conducting plate by use of adhesives and a conductive coating that lowers the electrical resistance at the joint between the two electrode components.

It is a feature of the present invention that the backplate, the conductor elements and the electrode surface form a subunit that are connected at joints by the metallurgical bonding process of diffusion bonding.

It is another feature of the present invention that the diffusion bonded subunit of the backplate, conducting elements and electrode surface has its electrode surface separately catalytically coated to form the activated surface for use during electrolysis.

It is still another feature of the present invention that the diffusion bonded subunit with its backplate, conductor elements and catalytically coated active electrode surface is mated to a conducting plate or surface by means of an adhesive and a conductive coating that lowers the electrical resistance at the joint or interface between the two electrode components.

It is an advantage of the present invention that an electrode is obtained by the metallurgical bonding process of diffusion bonding which eliminates rough spots that could puncture the membrane.

It is another advantage of the present invention that the amount of manual labor necessary to produce an electrode is dramatically reduced.

It is still another advantage of the present invention that an electrode is obtained which is smooth at the joints between the individual components and is lower in weight and cost.

It is yet another advantage of the present invention that heat distortion in the electrode produced by the process of diffusion bonding is more easily controlled than by conventional fabrication steps.

It is a further advantage of the present invention that warpage of the electrodes is avoided and the required tolerances are maintained in an electrode produced by the subject process.

These and other objects, features and advantages are obtained in the electrode produced by the process of diffusion bonding the joints of the separate components and the electrode together to form an electrode subunit of a backplate, conducting elements and an electrode surface that is mated to a conducting plate by an adhesive and a conductive coating that lowers the electrical resistance at the joint or interface between the backplate and the conducting plate.

BRIEF DESCRIPTION OF THE DRAWINGS

The advantages of this invention will become apparent upon consideration of the following detailed disclosure of the invention, especially when it is taken in conjunction with the accompanying drawings wherein.

DETAILED DESCRIPTION OF THE PREFERRED EMBODIMENT

Figure 1:
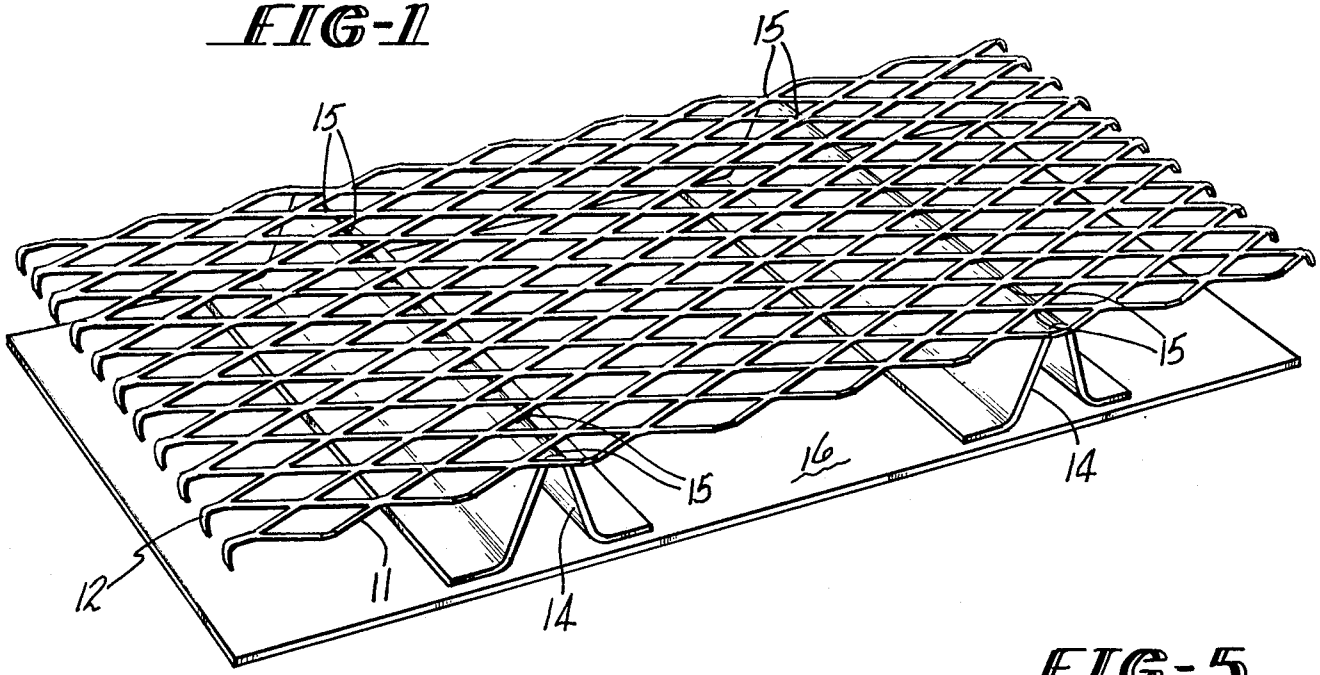
FIG. 1 is a front perspective view of an electrode subunit produced by the metallurgical bonding process of diffusion bonding.

FIG. 1 shows a front perspective view of an electrode subunit indicated generally by the numeral 10 that is formed by the process of diffusion bonding. The electrode subunit 10 includes an electrode surface 11 that is shown as being a wire mesh. This electrode surface 11 may be formed from an expanded metal mesh which is flattened or unflattened, perforated or punctured sheets, flat sheets, or sheets having slits or louvered openings. The electrode surface 11 could also be formed from a series of rods that are metallurgically bonded to the conducting elements 14. An expanded metal mesh is a preferred form. The electrode surface 11 may be turned downwardly at its extremities 12 to prevent rough edges from coming into contact with a membrane in an assembled electrolytic cell.

The electrical conducting elements 14 are connected to the electrode surface 11 at a plurality of individual locations or joints 15 by metallurgical bonding, such as diffusion bonding. The conducting elements 14 may be in the form of hollow concave-shaped ribs, hollow tubes, or solid straight bars with or without holes. If holes are employed, they are intermittently spaced to permit fluid passage. The bottom surfaces of the conducting elements 14 are metallurgically bonded by the diffusion bonding process to the backplate 16.

Where the subunit 10 is to be used as an anode in an electrolytic cell, the electrode surface 11, the electrical conducting elements 14, and the backplate 16 are fabricated from a conductive metal such as titanium or tantalum, columbium, niobium, but which is preferably titanium or titanium alloy. Although Grade 7 titanium is preferred, it is possible to use Grade 1 or 2. Grade 12 is preferred when superplastic forming is employed to shape the subunit components. These grades of titanium are established by the ASTM Standard B 265-79. Titanium is especially useful where electrolysis of alkali metal chloride brines is involved. Other suitably fabricated conductive metals could include copper, nickel, silver, steel, magnesium or aluminum and alloys of these metals for electrodes as long as they are compatible in the type of electrolytic process in which they are employed. Copper sputtered onto titanium in a coating with a thickness of about 1000 Angstroms to about 20,000 Angstroms can also be employed to reduce the oxide formation that tends to occur on the metal over time. This oxide formation increases the electrical resistance at the joint or between the mated surfaces of metal.

Where the subunit 10 is to be used as part of an electrode that serves as a cathode, the components are preferably fabricated from a nickel material, such as nickel 200. A nickel 301 that is precipitation hardened can also be satisfactorily used for the cathode conductive metals, as well as steel, nickel, copper or coated conductive materials such as nickel coated copper.

Figure 2:
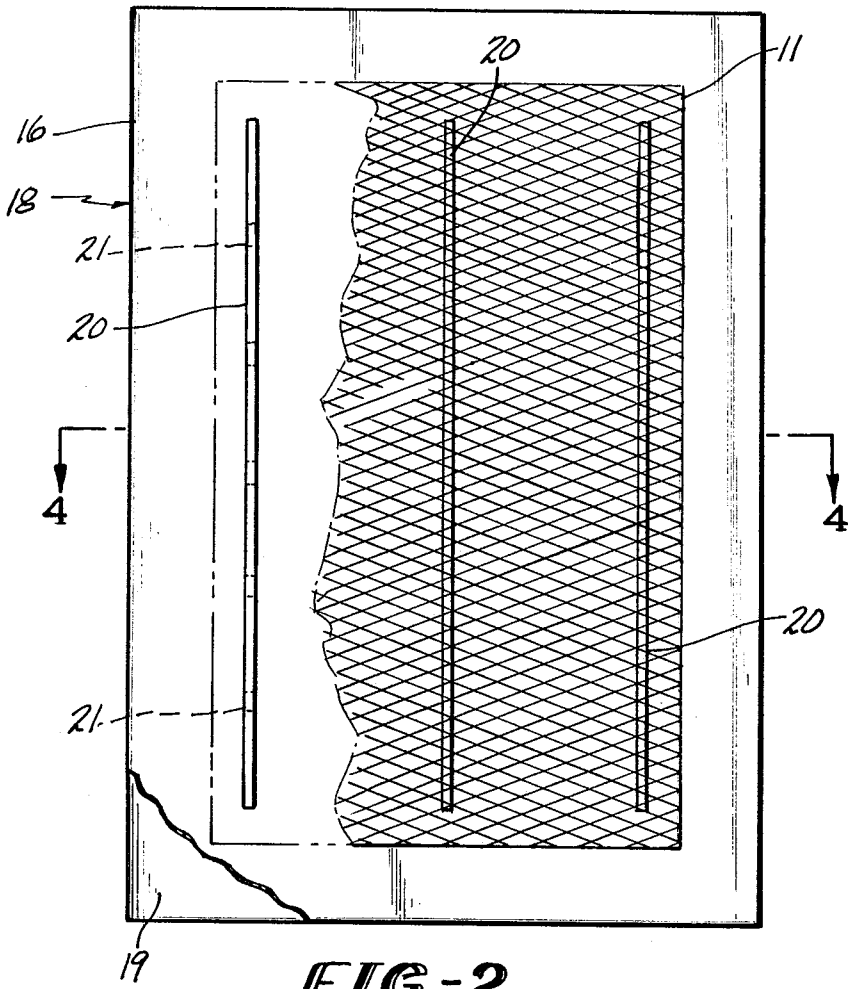
FIG. 2 is a top plan view of an electrode of the present invention with a portion of the electrode surface and the backplate broken away.

FIG. 2 shows an electrode subunit 18 with the backplate 16 bonded to a generally planar mating conducting plate 19 formed of copper because of its conductive qualities and relative low cost. The electrode subunit 18 has electrical conducting elements in the form of blades 20 which connect backplate 16 to the electrode surface 11. The electrical conducting elements or blades 20 have passages 21 therethrough to permit electrolyte to flow through the channels between the backplate 16 and the membrane (not shown) in an assembled cell. The blades 20 extend generally vertically from bottom to top in an assembled cell when the electrode is in an operating position. The blades 20 could equally well be horizontally or obliquely oriented in an assembled cell.

Figure 4:
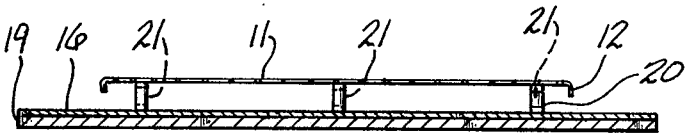
FIG. 4 is a sectional view taken along the lines 4—4 of FIG. 2 showing the diffusion bonded joints in the electrode produced by the diffusion bonding process.

FIG. 4 shows a sectional view of the assembled structure taken along the lines 4—4 of FIG. 2. The backplate 16 is bonded to the conducting plate 19 in a manner that will be described hereafter.

An adhesive is applied to the backplate 16 and/or the conducting plate 19 after appropriate surface preparations. These surface preparations include a cleaning to remove the presence of any oxides, degreasing and the removal of any other surface contaminants. The oxides can include oxides of titanium, nickel, zirconium, tantalum, vanadium, or other base metals. Where the electrical conducting elements are in the form of blades 20, the blades are milled for proper sizing and drilled to provide the passages 21. Cleaning must then be accomplished to remove any cutting fluids remaining from the milling and drilling operations. This cleaning consists of immersing or dipping in an alkaline solution or organic solvent, or immersing or dipping in a dilute acid. Alternately, the cleaning agent can be brushed on. The cleaning agent is then rinsed or removed from the applicable surfaces by either immersion or spot rinsing.

Figure 3:
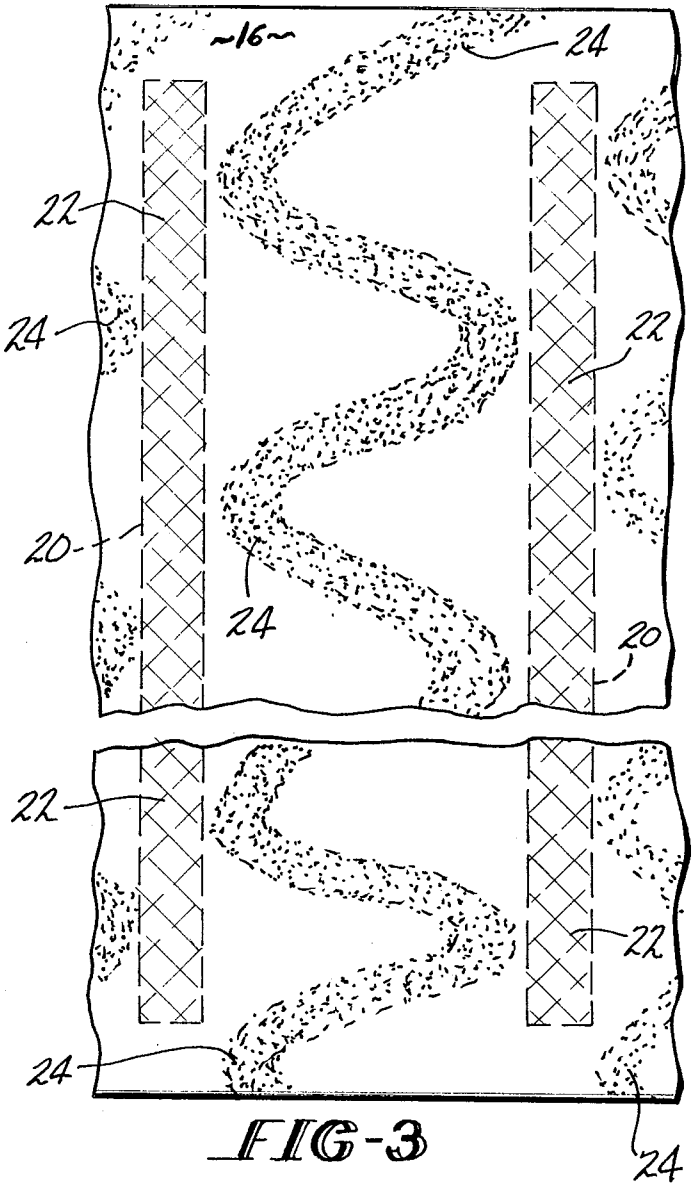
FIG. 3 is a reverse plan view of a portion of the electrode of FIG. 2 showing the location of the adhesive and the electrical resistance lowering conductive coating applied to the backplate to fasten the electrical conducting plate thereto.

Thus prepared and as illustrated in FIG. 3, a conductive coating 22 of a liquid metal mixture comprised of between about 20 and about 30% by weight indium and between about 70 and 80% by weight gallium, preferably between about 23 and about 26% by weight indium and between about 74 and 77% by weight gallium, is applied to the reverse side of backplate 16 in line with the conducting elements or blades 20 that have been previously metallurgically bonded to the backplate. This conductive coating is a eutectic having a melting point of approximately 15.7° C. at the eutectic composition of 24.5% by weight indium, so it can be easily applied to the surfaces even at room temperature. The conductive coating 22 does not immediately amalgamate or otherwise bond the backplate 16 to the conducting plate 19. The conductive coating 22 is applied preferably in a one inch wide strip by wiping on with a suitable applicator, such as a paint brush, swab or wiping cloth. As described in U.S. Pat. No. 4,434,846 to Woodard et al., herein specifically incorporated by reference in pertinent part, the conductive coating 22 serves to reduce the electrical contact resistance between the conducting plate 19 and the backplate 16.

The conductive coating 22 generally is not intended to function as a bonding agent and, in fact, subsequent data will show a lack of bonding between adjacent mating surfaces. However, it was found that the conductive coating by itself will bond the backplate 16 to a conducting plate 19, for example, when subjected to a temperature of about 90° C., a minimal pressure of about 10 psi, and aged for 3 days. These are conditions that occur during normal operation of a filter press membrane type of a cell. It is thus possible for an electrolytic cell to be assembled without the use of a specially selected adhesive and have some bonding occur after normal use.

An adhesive 24 is applied to the backplate 16 between the electrical conducting elements or blades 20 in any pattern or uniformly. As seen in FIG. 3, it is applied in an illustrative Z-type pattern. The adhesive 24 is also applied to the backplate 16 outside of the blades 20. This application pattern permits the adhesive 24, when compressed by having the backplate 16 mated to the conducting plate 19, to be dispersed and spread out to cover substantially most of the contact surface area between the backplate 16 and the conducting plate 19.

The adhesive 24 may be one of several types of conductive or non-conductive adhesives. It may be a silver-filled epoxy, a copper-filled epoxy, a silver coated copper-filled epoxy, a tin-lead solder mix in paste form or preformed strips, a tin-silver solder mix in paste form or preformed strips, or a non-conductive epoxy, as will be explained hereafter. Whether the adhesive 24 is conductive or non-conductive, its use obviates the need for time-consuming, labor-intensive welding which can cause heat distortion in the backplate 16 or the conducting plate 19 due to heat buildup.

The adhesive 24, when non-conductive, can be a clear, low viscosity two-component expoxy adhesive system that contains no solvent and cures quickly at room temperature. Commercially available two-component epoxy adhesives of this type serve as excellent thermal and electrical insulators with chemical resistance to aqueous solutions and other chemicals. Such non-conductive adhesives, when mixed in a one to one ratio by weight or volume, cure at ambient temperatures within 24 hours, but bonding can be accelerated to about 4 hours when cured at about 160 to about 170° F.

Silver-filled two-component conductive epoxy coatings may also be employed which exhibit high electrical conductivity and heat resistance after curing. Such adhesives can be employed by brushing, spraying or screen printing in coatings of two mils or less. Such adhesives are heat cured generally at temperatures from about 80° C. to about 150° C. for about two hours to about 3 minutes, dependent upon the particular formulation employed.

Copper-filled adhesives may be employed that are paste like in consistency and which will cure in about 30 minutes to about 120 minutes at temperatures at about 150° C. or about 125° C., respectively.

The solder mix may be a commercial paste formulation that contains about 95% tin and about 5% silver by weight, or alternately about 60% tin and about 40% lead by weight mixed with a flux. These type of solder pastes are especially useful in wetting copper and nickel.

The metallurgical bonding process of diffusion bonding is employed on the electrode subunits 10 and 18. The backplates 16, electrode surfaces 11, and the electrical conducting elements 14 and 20 are milled and cut to the proper size. Then they are cleaned to remove the oxides or other contaminants previously described from the contact surface areas. This cleaning is accomplished by the aforedescribed techniques. After drying, any areas not to be bonded, such as the areas to be subjected to superplastic forming, are coated with an appropriate stop-off compound, such as boron nitride, yttria, alumina or other stable oxides. The subunit 10 or 18 is placed in an appropriate mold or workpiece in a vacuum chamber which is heated and maintained at a temperature that is optimum for the metals being formed and bonded together. Diffusion bonding temperatures can vary from about 787° C. to about 1010° C. For an electrode formed of titanium, the temperature can be preferably between about 815° C. to about 898° C., while an electrode formed of a nickel will preferably range from about 871° C. to about 954° C. The heat is provided within the press or workpiece, for example, by resistance-heated nichrome wire that may be embedded in ceramic platens. Other portions of the tooling may be formed of stainless steel.

The tooling serves as a press to maintain the structure being bonded under pressure that can vary from about 100 pounds per square inch (psi) to about 2000 psi or more, preferably from about 150 psi to about 650 psi over a time period of 30 minutes to about 15 hours. The pressure may be applied hydraulically or by a gas that may also protect against surface enrichment of the metals being bonded. For example, argon gas or helium may be employed. The tooling or platens may be held together in counter resistance to the internal forces by hydraulics. This process will permit the electrode subunits 10 or 18 to be bonded together in all areas except where the stop-off compound has been applied. Once subjected to sufficient pressure and for a sufficient length of time, the subunits 10 or 18 are allowed to cool and are removed from the press and tooling.

If it is desired to superplastically form some of the components of the electrode subunit, such as the electrical conducting elements 14 of subunit 10, the subunit 10 is left in the press after the diffusion bonding temperature and time cycle has been completed. The bonding occurs to the unstopped-off areas. Gas pressure is increased by introduction of an appropriate inert gas into the tooling area at a controlled rate until a breakthrough in the stopped-off area occurs so the gas creates a flow path to the stopped-off areas. This causes the areas to be superplastically and uniformly formed, while avoiding strain rates in excess of the superplastic range of the material being formed. It is desirable to have a low breakthrough pressure-time product, such as less than 100 psi-minutes. The combined superplastic forming and diffusion bonding operation is described in detail in U.S. Pat. No. 3,927,817.

Figure 5:
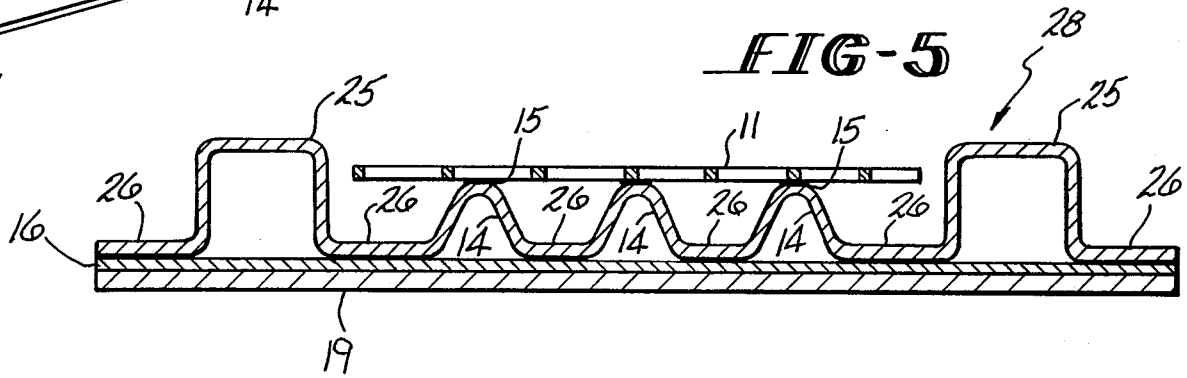
FIG. 5 is a sectional view of an alternative embodiment showing an electrode produced by superplastic forming and the diffusion bonding process.

In the case of the electrode shown in FIGURE 5, diffusion bonding and superplastic forming can be employed to fabricate the desired electrode frame, indicated generally by the numeral 28. The electrode surface 11, the electrical conducting element 14 and the frame channels 25 are diffusion bonded to the backplate 16, except where the stop-off compound has been applied to permit breakthrough to occur. The A-shaped configuration of the electrical conducting elements 14 and the generally rectangular shape of frame elements 25 are obtained by superplastic forming of the components. It may be necessary to first diffusion bond the backplate 16 to the unstopped-off areas 26 of the sheet of metal from which the frame elements 25 and the electrical conducting elements 14 are formed prior to superplastic forming these elements. It may then be necessary to diffusion bond the electrode surface 11 to the superplastically formed conducting elements 14. The conducting plate 19, which is made of copper, may then be appropriately bonded to the backplate 16.

Alternately, the electrode frame 28 could be fabricated without the backplate 16 by directly bonding the unstopped-off areas 26 of the sheet of metal from which the frame elements 25 and the electrical conducting elements 14 are formed to the conducting plate 19. The electrode surface 11 could also be flush against the frame elements 25 and either at a height that is below, even with, or above the height of the frame elements 25.

The electrode surfaces are then ready to be coated with a high surface area coating or an activated coating, such as any of the commercially available catalytic coatings, for example those prepared by thermal decomposition, electrodeposition, sputtering, vapor phased deposition, and ion implantation. The application of the high surface area or activated or catalytic coatings to the electrode surfaces 11 at this point in the process has the additional advantage of employing a coating application temperature cycle that is lower than that employed in the diffusion bonding operation. Minimum warpage occurs in the electrodes and tolerances in the electrodes thus can be maintained. The catalytically active coatings may be selected from the group consisting of lanthanum, pentanickel, Raney-nickel, precious metals, precious metal oxides, electroplated alloys of nickel and leachable metals of zinc, cadmium or aluminum.

In order to exemplify the results achieved, the following Examples are provided without any intent to limit the scope of the instant invention to the discussion therein.

EXAMPLE I

A 1"×2" coupon of copper alloy C-110 approximately 0.045 inches thick, a 1"×2" coupon of nickel 200 commercial grade approximately 0.055 inches thick, and a 1"×2" coupon of Grade 1 titanium approximately 0.0385 inches thick with copper sputtered on one side were deburred along the edges and cleaned as described hereafter. The coupons were vapor degreased. The copper and copper sputtered titanium coupons were cleaned in a 12% $H_2SO_4$ solution for about 10 seconds at room temperature and then rinsed in distilled water and dried. The nickel 200 coupon was cleaned in a solution of about 37.8 milliliters of water, 56 milliliters of $H_2SO_4$ and 85.2 milliliters of $HNO_3$ at a temperature of about 20° C. to about 35° C. for 10 seconds, rinsed with distilled water and dried.

TABLE 1

CONTACT SURFACE PROPERTY SUMMARY

| | Bonding Adhesive | Electrical Resistance (Milliohms) | Shear Stress Load (pounds) (1" × 1" Lap Joints) |
|---|---|---|---|
| Ni/Cu Couples | Copper-filled Single-component Adhesive | 0.19 | 1310 |
| | 95% Sn - 5% Ag Solder Paste | 0.09 | 1590 |
| | Low Electrical Resistance Conductive Coating | 0.19 | No Bond |
| Cu Sputtered Ti/Cu Couples | Copper-filled Single-component Adhesive | 0.95 | 1320 |
| | 95% Sn - 5% Ag Solder Paste | Did not wet Cu sputtered Ti | No Bond |
| | Low Electrical Resistance Conductive Coating | 0.66 | No Bond |

A thin layer of 95% tin—5% silver by weight solder paste was applied to the coupons and the coupons were mated, loaded in a press to a pressure of approximately 100 psi and heated to about 270° C. for about 10 minutes. The coupons were then cooled to below about 200° C. while under pressure. Kelvin clips were attached to the free end of the couples for measurement of the electrical resistance with a Biddle digital resistance meter. The readings thus recorded measured the serial resistance comprising the resistance from the two mating components in the couple and the junction between the two components. The joint resistance is measured in milliohms. The shear stress of the bond between the couples was also noted. These data are recorded in Table 1. No bonding was achieved with the copper and copper sputtered titanium coupons.

EXAMPLE II

A copper-filled, single-component, high strength adhesive designed for use in microelectronic applications was evaluated by application to coupons of the same composition and dimension as recited in Example I above. The coupons were cleaned according to the procedure described in Example I. Once cleaned, a thin layer of the copper-filled adhesive was spread on the clean surfaces and the surfaces were mated. The mated surfaces were then loaded in a press to approximately 100 psi and were cured at a temperature of about 170° C. to 180° C. for about 30 minutes. This adhesive resulted in a joint with a somewhat elevated electrical resistance for the copper and copper sputtered titanium couples, but with excellent shear strength. The results are also shown in Table 1.

EXAMPLE III

Coupons of the identical size and material were selected and cleaned as described in Example I above. A conductive coating of between about 20 and 30% by weight indium and between about 70 and 80% by weight gallium was applied to one of the coupons and the pairs identified in Table 1 were mated together. The conductive coating reduces the electrical resistance at the joint or interface between the couples. The couples were loaded in a press to approximately 100 psi and cured for about 16 hours from about 195° C. to about 200° C. Reduced electrical resistances were recorded as shown in Table 1, using the same measuring techniques as described with respect to Example I, but no bonding between the couples took place.

EXAMPLE IV

Coupons of the identical size, grade and thickness were selected and cleaned as described in Example I. An additional 1"×1" titanium coupon of Grade 1 with a thickness of about 0.039 inches was also selected, cleaned and mated with a matching copper coupon. The coupons were not bonded together by a specific adhesive. Table 2 shows the effect of aging on the electrical joint resistance of couples of different composition. The resistance is measured in milliohms. The couples were aged at about 90° C. temperature and 10 psi loading. Table 2 compares the electrical resistance of the unbonded couples not employing a conductive coating with couples employing a conductive coating of the type described in Example III that lowers the electrical resistance at the joint or interface between the coupons. Those couples employing the conductive coating show significantly lower electrical resistance. The conductive coating appears to prevent or significantly hamper the oxidation of the mating contact surfaces that can significantly increase joint resistance with aging. The copper-copper sputtered titanium coupons employing the conductive coating showed decreases in electrical resistance with aging. Those coupons mated without the electrical resistance lowering conductive coating on the copper-copper sputtered titanium coupons have ranges for the resistances recorded at 11 and 17 days because of the multiple coupons tested and the large difference in readings. The copper coupons mated without the conductive coating showed some reduction in the measured resistance with aging because of what is thought to be attributed to the formation over time of copper oxides which exhibit semiconductor qualities.

TABLE 2

CONTACT SURFACE STUDY

| Aging Time (Days) | Resistance (milliohms) Cu/Cu | Cu/Ni | Cu/Cu Sputtered Ti | Cu/Ti |
|---|---|---|---|---|
| Couple With Electrical Resistance Lowering Conductive Coating | | | | |
| 1 | 0.051 | 0.21 | 0.98 | — |
| 3 | 0.057 | 0.19 | 1.02 | 2.60 (4 days) |
| 8 | 0.045 | 0.21 | 0.63 | 0.95 |
| 10 | 0.055 | 0.07 | 0.64 | — |
| 15 | 0.055 | 0.19 | 0.65 | — |
| 25 | 0.060 | 0.14 | 0.85 | — |
| 38 | 0.048 | 0.186 | 0.736 | 1.1 |

TABLE 2-continued

| Aging Time (Days) | CONTACT SURFACE STUDY Resistance (milliohms) Cu/Cu | Cu/Ni | Cu/Cu Sputtered Ti | Cu/Ti |
|---|---|---|---|---|
| | Couples Without Electrical Resistance Lowering Conductive Coating | | | (28 days) |
| 0 | 0.15 | 0.55 | 4.4 | — |
| 4 | 9.58 | 2.80 | 50.5 | 170 |
| 6 | 7.33 | 63.50 | 60.5 | 190 (8 days) |
| 11 | 8.05 | 142.5 | 35-100 | — |
| 17 | 10.50 | 135.6 | 60-70 | — |
| 27 | 6.95 | 7.0 | 65 | 130 (28 days) |

EXAMPLE V

One inch square couples of titanium and copper and nickel and copper of the thickness and grade described in Example I were mated together using a silver-filled epoxy that is solvent-based and heat cured. The adhesive is a two-component adhesive that is electrically conductive. The couples were cured at about 100° C. for one hour under an applied load of about 100 psi. Two samples of each couple were initially employed and electrical resistance was measured using the procedure explained in Example I. Resistance was also recorded after the couples had been aged at about 90° C. for one day. Initial shear strengths were in excess of 500 psi. These couples show a range of resistance values in milliohms which did not tend to increase significantly over a short period of time. These results are shown in Table 3.

TABLE 3

| Couple | Electrical Resistance (milliohms) Initial | 1 Day |
|---|---|---|
| Cu—Ni | 0.1, 0.1 | 0.2, 0.2 |
| Ti—Cu | 2.1, 2.4 | 2.1, 2.4 |

EXAMPLE VI

One inch square coupons of nickel and copper of the thickness and grade described in Example I were selected, cleaned as described in Example I and mated or coupled together. Prior to mating a uniform film of a conductive coating of the type described in Example II was applied to the mating surface of both coupons, except for a ⅛ inch wide strip along three sides. In this ⅛ inch strip on both coupons a copper-filled, single component epoxy adhesive was applied in a uniform thin film. Three couples of nickel-copper coupons were thus formed and were cured for about 30 minutes at about 150° C. The couples were subjected to less than 50 pounds per square inch pressure during curing. Aging was conducted at about 90° C. to simulate conditions in an operating filter press membrane electrolytic cell of the chlor-alkali type. The following table shows the electrical resistance in milliohms measured in the manner described in Example I. The shear stress load of the bonds between the couples was measured for couple #1 as 60 pounds on Day 1 and for couple #3 as 72 pounds on Day 70. No measurement was made for couple #2.

TABLE 4

| Aging Time (Days) | Resistance (Milliohms) Cu/Ni #1 | Cu/Ni #2 | Cu/Ni #3 |
|---|---|---|---|
| 1 | .122 | .124 | .117 |
| 5 | — | .121 | .133 |
| 30 | — | .118 | .128 |
| 70 | — | .110 | .110 |

EXAMPLE VII

One inch square coupons of copper, nickel and titanium of the thickness and grade described in Example I were selected, cleaned as described in Example I and mated or coupled together to form three sets each of copper-nickel and copper-titanium couples. Prior to mating, a uniform film of a conductive coating of the type described in Example III was applied to the mating surface of the copper coupon of each couple. A uniform film of a copper-filled, single component epoxy adhesive was applied to the entire surface of the nickel and titanium coupons. The couples were cured under 50 pounds per square inch pressure for 30 minutes at 145° C. The couples were aged at about 90° C. The following table shows the electrical resistance in milliohms measured in the manner described in Example I.

The shear stress load of the bonds between the couples were measured at various times. Copper-nickel couple #1 had 415 pounds on Day 1, copper-nickel couple #2 had 620 pounds on Day 70, and copper-nickel couple #3 was not measured. Copper-titanium couple #1 had a shear stress load of 670 pounds on Day 1, copper-titanium couple #3 had 510 pounds on Day 70, and copper-titanium couple #2 was not measured.

The data suggests that the copper-filled single component epoxy adhesive did not protect the surface of the nickel and titanium coupons from oxidation.

TABLE 5

| Couple | Resistance (Milliohms) at Various Aging Times (Days) Day 1 | Day 30 | Day 70 | Shear Stress Load (Pounds) |
|---|---|---|---|---|
| Cu/Ni #1 | .280 | — | — | 415 (Day 1) |
| Cu/Ni #2 | .185 | .165 | .175 | 620 (Day 70) |
| Cu/Ni #3 | .500 | .650 | 1.120 | — |
| Cu/Ti #1 | 6.1 | | | 670 (Day 1) |
| Cu/Ti #2 | 18.6 | 34.2 | 52.5 | — |
| Cu/Ti #3 | 2.9 | 3.9 | 4.5 | 510 (Day 70) |

EXAMPLE VIII

A 0.15 square meter filter press membrane chlor-alkali electrolytic cell employing a half anode and half cathode was fabricated. The electrodes were formed by utilizing diffusion bonding of a mesh electrode surface to generally vertical electrical conducting elements or blades and the blades to the backplates. The electrode subunits were mounted to copper conducting plates with adhesives. The anode was titanium and was bonded to its conducting plate using a copper-filled, single-component epoxy after the mating surfaces were cleaned as described in Example I. A conductive coating of the type described in Example III that lowers the electrical resistance at the joint or interface was applied to the backplate in line with the conducting blades prior to mating the conducting plate to the backplate. The cathode assembly was formed from a nickel electrode subunit soldered to the copper conducting plate with a 95% tin, 5% silver solder compound. A nickel sheet was soldered with the same solder material to the opposing side of the copper conducting plate to control the bimetallic expansion that results from heating.

The cell was initially operated at a current density of about 2.4 kiloamperes per square meter. The cell performance averaged 3.04 volts and 94.9% current efficiency with a DC power consumption of 2148 kilowatt hours per metric ton of caustic produced. The cell employed a FLEMION® 757 membrane, 229 grams per liter of NaCl, and operating at a temperature of 88° C., producing a 34.92% concentrated caustic.

Voltage losses normalized to a current density of 3 kiloamperes per square meter were 5 millivolts through the anode and 1 millivolt through the cathode.

EXAMPLE IX

A 0.15 square meter filter press membrane electrolytic cell employing a half anode and a half cathode was fabricated. The electrodes were formed by utilizing diffusion bonding of a mesh electrode surface to generally vertical electrical conducting elements or blades and the blades to the backplates. The electrode subunits were mounted to copper conducting plates with adhesives. The titanium anode subunit was bonded to its conducting plate using the copper-filled, single-component epoxy of Example VI, after the mating surfaces were cleaned as described in Example I. A conductive coating of the type identified in Example III that lowers the electrical resistance was applied to the reverse side of the backplate in line with the conducting blades prior to mating the conducting plate to the backplate. The cathode was formed from an electrode subunit of nickel adhesively bonded to the copper conducting plate with a two-component, low viscosity, non-conductive epoxy adhesive system combined with a conducting coating that lowers the electrical resistance between the subunit backplate and the copper conducting plate. The conductive coating was applied as with the anode. The mating of the surfaces of the backplates and the copper conducting plates also employed a pressure contact joint that is a silver plated berylium copper sold commercially under the ELECTROMATE tradename.

The cell was operated with pumped electrolyte circulation and a FLEMION® 775 membrane. For the first 16 days of operation cell performance averaged 3.31 volts and 94.9% current efficiency at 3.6 kiloamperes per square meter current density. Cell performance for the next 14 days of operation ranged from about 93.5% to about 95% current efficiency at current densities between about 4.5 and about 5.0 kiloamperes per square meter. After 74 days of operation hardware voltage losses at 6.0 kiloamperes per square meter were 8.5 millivolts for the anode and 8.5 millivolts for the cathode. Voltage losses normalized to 3.0 kiloamperes per square meter were 4.5 millivolts for the anode and 4.5 millivolts for the cathode.

While the preferred structure made by the diffusion bonding process in which the principles of the present invention have been incorporated is shown and described above, it is to be understood that the invention is not to be limited to the particular details thus presented, but in fact, widely different means may be employed in the practice of the broader aspects of this invention. For example, it is possible to metallurgically bond the electrode surface 11 to the electrical conducting element 14 or 20 by the diffusion bonding technique and then bond the combined electrode surface-electrical conducting elements to the backplate 16 by means of one of the adhesives disclosed and discussed herein in combination with the conductive coating also discussed. The conductive coating would then be applied along the center line of the conducting elements with the adhesive applied along the outer sides of the conducting element surface to be mated to the backplate.

It is possible to assemble the electrode subunits without the use of any adhesives by assembling the electrodes in a horizontally oriented, vertically rising stack and then compressing the assembled electrode stack. The stack could then be rotated 90° to a vertical orientation and operated.

It is to be understood also that although only a half electrode is shown in FIGS. 2''5, the electrode can equally well be a full electrode with two active surfaces on opposing sides. The full electrode may be either monopolor or bipolar. The full electrode would then merely have the electrode subunits 10 or 18 on both sides of the electrical conducting plate 19 with the desired adhesive and conductive coating application applied to both backplates in the manner described with reference to FIG. 3 prior to applying the backplates 16 to both sides of the conducting plate 19. It is also possible in a bipolar configuration to adhesively bond the cathode subunit, for example made of nickel, directly to the anode subunit, for example made of titanium, utilizing the conductive coating and omitting the conducting plate.

Further, it should be understood that the electrode subunits and the electrodes produced by the processes described in this disclosure may be used in any type of electrolytic process and are not to be limited to just utilization in chlor-alkali cells. For example they could be employed in water electrolytic cells, whether employing alkaline or acid electrolytes, HCl electrolyzers, fuel cells, whether employing molten carbonate or phosphoric acid electrolytes, electrowinning cells for lead, copper, zinc, nickel or manganese, and electroplating cells for nickel, chromium and copper.

The scope of the appended claims is intended to encompass all obvious changes in the details, materials, arrangement of parts and processes which will occur to one of skill in the art upon a reading of the disclosure.

What is claimed is:

1. A subunit for an electrode of an electrolytic cell comprising:

(a) a backplate formed of a corrosion resistant metal;

(b) conducting elements formed of a an electrically conductive metal and at least having a corrosion resistant coating, the conducting elements being metallurgically bonded by diffusion bonding to the backplate by subjecting to heating and pressure, the conducting elements further being superplastically formed to a desired shape; and (c) an electrode surface formed of a corrosion resistant material metallurgically bonded by diffusion bonding to the conducting elements by subjecting to heat and pressure the backplate, conducting elements and electrode surface thereby forming a single connected subunit.

2. The subunit according to claim 1 wherein the subunit is heated to a temperature of between about 871° C. to about 954° C. and subjected to a pressure of about 200 to about 350 pounds per square inch for at least about 60 to about 90 minutes.

3. The subunit according to claim 2 wherein the corrosion resistant metal of the backplate, electrode surface and the coating of the conductive element is nickel.

4. The subunit according to claim 3 wherein the electrode surface is coated with a catalytically active or high surface area coating after the subunit is diffusion bonded.

5. The subunit according to claim 4 wherein the coating is selected from the group consisting of lanthanum pentanickel, Raney-nickel, precious metals, precious metal oxides, electroplated alloys of nickel and leachable metals of zinc, cadmium or aluminum.

6. The subunit according to claim 1 wherein the subunit is heated to a temperature of between about 815° C. to about 898° C. and is subjected to a pressure of about 200–300 pounds per square inch for at least about 60 to about 90 minutes.

7. The subunit according to claim 6 wherein the corrosion resistant metal of the backplate, electrode surface and coating of the conductive element is at least partially titanium.

8. The subunit according to claim 7 wherein the electrode surface is coated with a catalytically active or high surface area coating after the subunit is diffusion bonded.

9. The subunit according to claim 7 wherein the corrosion resistant metal of the backplate is copper sputtered onto titanium.

10. The subunit according to claim 1 wherein the subunit is bonded to a conducting plate by applying an adhesive to the backplate and mating the conducting plate to the backplate.

11. The subunit according to claim 10 wherein the adhesive is a non-conductive two-component adhesive.

12. The subunit according to claim 10 wherein the adhesive is a conductive copper-filled single-component adhesive that is bonded under pressure.

13. The subunit according to claim 12 wherein the adhesive is cured at about 125° C. to about 150° C. for between about 30 minutes to about 120 minutes.

14. The subunit according to claim 10 wherein the adhesive is solder consisting of about 95% tin and about 5% lead that is mated to the conducting plate and the backplate under about 100 pounds per square inch pressure, heated for about 10 minutes to about 270° C. and cooled to less than about 200° C. under pressure.

15. The subunit according to claim 10 wherein the conducting plate is formed from copper.

16. The subunit according to claim 10 wherein a conductive coating consisting of about 20% to about 30% by weight indium and about 80% to about 70% by weight gallium is applied to the backplate in line with the conducting elements prior to mating the conducting plate to the backplate to lower the electrical resistance between the conducting plate and the backplate.

17. The subunit according to claim 1 wherein the conducting elements are superplastically formed in an atmosphere of argon or helium of a breakthrough pressure of about 4 pounds per square inch to about 64 pounds per square inch with a stop-off compound.

18. The subunit according to claim 1 wherein the subunit is part of an electrode having a peripheral frame which is superplastically formed.

19. The subunit according to claim 18 wherein the peripheral shaped frame is superplastically formed in an atmosphere of argon or helium with a stop-off compound.

20. An electrode for an electrolytic cell, comprising:
(a) an electrode surface;
(b) a backplate;
(c) a plurality of conducting elements joined to the electrode surface and the backplate for conducting electrical energy from the backplate to the electrode surface; and
(d) a conducting plate bonded to the backplate by applying an adhesive to the backplate or the conducting plate and mating the conducting plate to the backplate.

21. The electrode according to claim 20 wherein at least the electrode surface and the plurality of conducting elements are metallurgically joined together by diffusion bonding by subjecting to heat and pressure.

22. The electrode according to claim 20 wherein the conducting plate is formed from copper.

23. The electrode according to claim 22 wherein the adhesive is a non-conductive adhesive that bonds the backplate to the conducting plate.

24. The electrode according to claim 22 wherein the adhesive is a conductive copper-filled adhesive that bonds the backplate to the conducting plate under pressure.

25. The electrode according to claim 24 wherein the adhesive is further cured at about 125° to about 150° C. for between about 30 minutes to about 120 minutes.

26. The electrode according to claim 22 wherein the adhesive is a solder consisting of about 60% tin and about 40% lead that is bonded to the conducting plate and the back plate under pressure.

27. The electrode according to claim 26 wherein the adhesive is bonded under about 100 pounds per square inch pressure, heated for about 10 minutes to about 270° C. and cooled to less than about 200° C. under pressure.

28. The electrode according to claim 22 wherein the adhesive is a conductive silver-filled adhesive that bonds the backplate to the conducting plate.

29. The electrode according to claim 22 wherein a conductive coating consisting of between about 20% to about 30% by weight indium and of between about 70% to about 80% by weight gallium is applied to the backplate in line with the conducting elements prior to mating the conducting plate to the backplate to lower the electrical resistance between the conducting plate and the backplate.

30. The electrode according to claim 22 wherein the conducting elements are superplastically formed.

31. The electrode according to claim 30 wherein the conducting elements are superplastically formed in an atmosphere of argon or helium of a breakthrough pressure of about 4 pounds per square inch to about 64 pounds per square inch with a stop-off compound.

32. The electrode according to claim 30 wherein the electrode has a peripheral frame that is superplastically formed.

33. The electrode according to claim 32 wherein the peripheral frame is superplastically formed in an atmosphere of argon or helium with a stop-off selected from the group consisting of yttria and boron nitride.

* * * * *